US008205718B2

(12) United States Patent
Taylor

(10) Patent No.: US 8,205,718 B2
(45) Date of Patent: Jun. 26, 2012

(54) BELAY DEVICE

(75) Inventor: David Kennedy Taylor, Edinburgh (GB)

(73) Assignee: Limpet Holdings (U.K.) Limited, Edinburgh (GB)

( * ) Notice: Subject to any disclaimer, the term of this patent is extended or adjusted under 35 U.S.C. 154(b) by 747 days.

(21) Appl. No.: 11/918,703

(22) PCT Filed: Apr. 19, 2006

(86) PCT No.: PCT/GB2006/001419

§ 371 (c)(1),
(2), (4) Date: Jan. 29, 2009

(87) PCT Pub. No.: WO2006/111737

PCT Pub. Date: Oct. 26, 2006

(65) Prior Publication Data

US 2009/0211846 A1 Aug. 27, 2009

(30) Foreign Application Priority Data

Apr. 19, 2005 (GB) ..... 0507806.8

(51) Int. Cl.
*A62B 1/06* (2006.01)

(52) U.S. Cl. ..... 182/231; 182/236; 182/19

(58) Field of Classification Search ..... 182/19, 182/231, 236

See application file for complete search history.

(56) References Cited

U.S. PATENT DOCUMENTS

| | | | | |
|---|---|---|---|---|
| 4,997,064 | A | 3/1991 | Motte et al. | |
| 6,814,186 | B1 * | 11/2004 | Harbers, Jr. | 182/231 |
| 7,063,306 | B2 * | 6/2006 | Sanders et al. | 254/361 |
| 7,198,134 | B2 * | 4/2007 | LeMieux | 182/8 |
| 7,798,288 | B2 * | 9/2010 | Blasek | 182/42 |
| 2007/0158137 | A1 * | 7/2007 | Petersen | 182/8 |

FOREIGN PATENT DOCUMENTS

| | | | |
|---|---|---|---|
| DE | 10048046 | A1 | 2/2002 |
| DE | 202004004117 | U1 | 5/2004 |
| FR | 2727026 | A | 5/1996 |
| WO | WO 95/16496 | A | 6/1995 |

* cited by examiner

*Primary Examiner* — Alvin Chin Shue
(74) *Attorney, Agent, or Firm* — Drinker, Biddle & Reath, LLP

(57) ABSTRACT

A belay device for protecting a climber on a rope from a fall has a powered winding reel to which the rope is attached. A control mechanism acts to prevent slack in the rope between the climber and the winding reel and includes load sensor that which, on detecting the weight of the climber on the rope, switches the operation of the device to a fall or descent mode where the winding reel is stopped and the climber is suspended by the rope. An electronic control and diagnostic system monitors the operation of the winding reel and switches its operation to a safe, fault mode when a fault is detected.

43 Claims, 8 Drawing Sheets

BELAY DEVICE

The present invention relates to safety devices for climbers. More specifically the present invention relates to the provision of a belay device which allows a climber to climb without a partner (belayer) whilst still being protected from the consequences of a fall.

Climbers protect themselves during the climbing process by attaching themselves to ropes, with these ropes being attached to the surface that they are climbing. The climber is attached to one end of the rope while his partner controls the feed of rope to the climber. In top rope climbing the rope is fed from above, either by a partner, positioned above the climber or from a partner positioned on the ground with the rope being fed up to a pulley positioned at the top of the climb and then down to the climber. In both cases, the climber is protected from the consequences of a fall by his partner maintaining a tight grip on the rope. If the climber falls then irrespective of whether the rope is supported from above him in top rope climbing or below him in lead climbing, it is the concentration and skill of the partner "belaying" him that makes him safe.

This technique is used both in outdoor and indoor climbing.

This technique means that climbers must pursue their sport with a partner. This is accepted as inevitable out of doors. However the difficulty of finding a partner to climb on indoor walls has resulted in the development of auto-belay devices for installation in indoor climbing centres. They are typically spring-loaded devices that do not require connection to a power supply. Such devices incorporate a load tape in place of the rope; the tape is wound around the central drum of a spring-loaded inertia reel. The spring action of the reel is always trying to draw in the tape, and if the tape is unloaded then the tape will reel back entirely into the device. With the reel attached to the top of the climb, the retracting tape is therefore clipped and secured to the floor at the base of the climb. A climber approaches the base of the climb and unclips the tape from a floor-mounted ring. He clips a carabiner at the end of the tape into his climbing belt and can commence the climb. If he accidentally lets go the end of the tape, then it shoots to the top of the wall. As he climbs, the spring-loaded action of the reel draws in the tape. If the climber falls then a clutch device within the reel lowers him slowly to the ground.

Existing auto-belay devices, generally take this form. These friction plate clutch devices are effective in providing adequate safety but they can generally only operate with climbers in the weight range of 35 to 140 kg and usually are restricted in the height of climbs they can provide protection for. Typically the height limit for these devices is 12 meters, but climbing walls provided for sport are increasingly of the order of 20 meters or more in height. Another potential drawback with the existing devices is the requirement for frequent maintenance and refurbishment, typically every 12 months.

Another type of prior art device uses a pneumatic cylinder to lower climbers to the ground.

In FR 2 727 026 (Brouty) the use of an electrically powered winch drum (winding reel), which has a control mechanism to control the tension in a climbing rope as a climber climbed was proposed. However, the control mechanism of the device disclosed has some disadvantages. In particular, in the event of a failure of the control mechanism, a dangerous situation could occur, with rope being paid out continuously from the winding reel. Additionally, the control mechanism proposed in FR 2 272 026 does not distinguish between the situation when a climber falls and when tension is applied to the climbing rope for other reasons, for example when a climber requires some 'slack' rope in order to manoeuvre on a climbing surface. None of the existing devices offer the facility to lift-a climber off the ground. Such a facility would be useful to allow easy maintenance of a climbing wall, for example in repositioning or replacing hand holds. An auto-belay device that included the option of a powered ascent would also find utility in non-sport activities such as building maintenance or tree surgery where safe rope climbing is required.

It is an object of the invention to provide a belay device to provide a safe system of climbing without requiring the assistance of a partner to belay the climber, that avoids at least one or more of the aforementioned disadvantages.

The present invention provides a belay device comprising:

a powered winding reel;

a climbing rope attached at one end to the winding reel and, in use of the device, to a climber a distal portion along said rope; and a control mechanism comprising load sensing means, and an electronic control and diagnostic system, said control mechanism being formed and arranged so as to control the powered winding reel in a first, climbing, mode wherein the winding reel operates to prevent slack in the rope between a said climber in use of the device and said winding reel, the load sensing means is formed and arranged to detect the weight of a said climber on the rope, and to switch the operation of the winding reel to a second, fall or descent mode, wherein the winding reel is stopped and a said climber is suspended by the rope, and the electronic control and diagnostic system is formed and arranged to monitor the operation of the powered winding reel and the control mechanism, and to switch the operation of the winding reel to a third, fault mode, when a fault is detected.

Preferably the winding reel is powered by an electric motor.

In the climbing mode, the control mechanism acts to prevent slack in the rope by directing the winding reel, via the electronic control and diagnostic system, to wind in the rope when slack is detected. When, the slack is removed the winding reel is directed to stop. When a light tension is applied to the rope, for example when a climber descends in a controlled fashion, the winding reel may be directed to pay out rope. In fall or descent mode, where the weight of the climber is applied to the rope the winding reel is directed to stop. Then unwinding of the rope to lower the climber to the ground can be initiated, in a number of ways as discussed hereafter. In fault mode the winding reel is stopped and an alarm is signalled.

The electronic control and diagnostic system takes inputs from the rest of the control mechanism including sensors. In response to these inputs it controls the powering of the winding reel. Typically the winding reel is powered by a three-phase electric motor and the electronic control and diagnostic system controls an inverter, which in turn controls the speed and direction of the motor, and hence of the winding reel. At the same time the electronic control and diagnostic system performs the diagnostic function. The diagnostic function can operate on a number of levels. The outputs from the control system including sensors, such as, for example, micro switches or potentiometers as described hereafter, can be compared with each other and any discrepancy initiates the fault mode. Similarly the signal inputs to the inverter can be compared with the output signals to initiate the fault mode. Other sensors may also be employed and used to input the diagnostic system, for example detecting the motion of the winding reel independently, or additional, 'redundant' sensors may be employed in the control mechanism for cross checking purposes. The diagnostic function provides essential additional safety in the operation of a belay device.

Although the risk of a malfunction of the control system the control system may be small, the consequences could be serious, potentially resulting in severe injury or even death to a climber. For example if the winding reel pays out rope uncontrollably due to a fault, a climber could be left without protection, at a dangerous height. It is considered that a belay device of the invention without an appropriate self diagnostic system would be unlikely to be given regulatory approval, such as CE approval for use.

Preferably the electronic control and diagnostic system is programmable. Preferably the inverter used to control the speed and direction of the winding reel is also programmable. The electronic programmable control system and inverter allows a wide range of functionality to be built into the control system and operational control of the speed and direction of the winding reel can be almost infinite. This allows the operation of the belay device of the invention to be altered to suit the conditions and the type of climbing required as discussed hereafter, by simply reprogramming the electronic control and diagnostic system.

It will be readily understood by the reader that the term climbing rope includes any type of line that is suitable for supporting the weight of a climber in the event of a fall. For example, the climbing rope may be a rope of natural or synthetic fibres, a webbing tape or a steel wire or rope. Advantageously the belay device of the present invention can be used with a conventional climbing rope, so that the climbing experience provided closely simulates that of climbing with a partner using such ropes.

The control mechanism can be constructed or programmed so that, in climbing mode, the winding reel winds the rope in whenever there is slack in the rope and will also unwind to pay out rope when under light tension i.e. less than the weight of a climber. This arrangement keeps the rope properly taut at all times during either top rope or lead climbing operations whilst allowing a climber to obtain more rope if required for maneuvering on the climbing surface.

However, for added safety, especially when being used by inexperienced climbers, it may be preferable that the operation of the winding reel be more restricted. For example in top rope climbing the climbing mode may only act to wind the rope in when it is slack and then simply stop when the slack is taken up i.e. the rope does not unwind when under light tension. This method of operation prevents a climber pulling out a quantity of free rope from the winding reel. This would result in the climber being inadequately protected in the event of a fall.

For safety reasons, in embodiments of the invention where the control mechanism operates the winding reel in a different fashion for either top rope or lead climbing, the belay device is preferably further provided with security means such as a lock and key or electronic code lock, which prevents operation in a manner inappropriate to the climbing method (top rope or lead) being attempted.

When a length of rope has been pulled from the winding reel and is not being held taut in a climbing situation, it has to be wound back onto the winding reel for next use. In such circumstances it has been found that the rope may coil loosely onto the drum unless some tension is applied to the rope as it is wound in. Such loose coils can catch on the mechanism of the belay device and impair its correct and safe operation. Therefore the belay device of the invention may optionally be fitted with a nip roller mechanism, formed and arranged to apply tension between a rope being wound onto the winding reel and the winding reel. The nip roller mechanism only operates when a special, rewinding mode is selected, to avoid interference with the normal operation of the control mechanism, which depends on rope tension. The nip roller arrangement also helps to direct or 'tail' the rope onto the winding reel in a regular layered fashion.

Where required, for example, where a very long length of rope, especially a thin rope such as a steel cable, is being used with a belay device of the invention, then a self-tailing mechanism may be fitted to provide improved control of the layering of the rope onto the winding reel. Self-tailing devices are well known in winding operations for long lengths of cable or rope. For example a self tailing device may comprise a guide, tensioning the rope, which moves back and forth the across the width of the winding reel as the rope is wound in, to direct the placement or the coils of rope as they are wound onto the reel.

The operation of the belay device of the invention ensures that the line is kept taut. In top rope climbing the control mechanism switches on the motor of the winding reel to wind in the rope whenever it is slack i.e. not under tension. This effectively simulates the situation in which a climber is attended by a partner who keeps the rope taut to ensure that, in the event of a fall, the climber does not fall freely for any substantial distance before being brought under control by the belay. In the event of a fall the control mechanism of the invention switches to fall mode and operates to stop the operation of the winding reel.

Where the winding reel is driven by a motor acting directly through a gearbox then depending on the motor and the gearbox ratios used in the drive train, the fallen climber will either be suspended from the belay line close to the point where they fell or their weight will be sufficient to turn the winding reel, gearbox and motor, gradually lowering the climber towards the ground. Preferably a drive train is selected which holds a climber in position, close to the point where they fell. Fallen climbers can then re-attach themselves to the climbing surface to continue the climb or they can activate the lowering sequence by a remote control device, as described below, to lower themselves to the ground with the winding reel operating under power. It can be readily appreciated that the rope should not unwind from the reel when the climber is climbing up the climbing surface or is stationary, standing on or holding onto the climbing surface. This would lead to a situation where the rope is slack and the climber would not be properly protected in the event of a fall. Accordingly in normal use the control mechanism only allows descent when the weight of the climber tensions the line.

Advantageously, the control mechanism of the invention further comprises a timer mechanism which, when an adjustable period of time has elapsed, will automatically activate the lowering sequence to lower a climber safely to the ground when the weight of a climber tensions the rope.

This automatic lowering of a climber, who tensions the rope with their weight, after a set period of time is particularly useful when children or novices are learning to climb. They do not have to operate a remote control to descend once they have spent some time attempting the climb. As the rate of descent is slow and controlled, they can, if they wish reattach themselves to the climbing surface without comprising safety. The lowering sequence ceases immediately the weight of the climber no longer tensions the rope and the control mechanism then operates as normal to keep the rope taut. If desired the time period can be set to zero so that lowering occurs whenever the weight of a climber tensions the rope.

Preferably the belay device of the invention includes a remote control device for initiating the operation of the belay device in its first mode and signalling the control mechanism to unwind the rope for descent when in its second mode. Preferably the remote control device is a wireless remote control. A duplicate remote control, which may be wireless or wired, may also be supplied to allow an assistant to operate the system if required, for example in an emergency. A remote control is conveniently carried by the climber, attached to their equipment or clothing. This avoids the requirement for a partner or assistant at any stage of the climb. The remote control can be programmed to allow a climber to stop during descent. This facility allows climbers to reattach themselves at a chosen point on a wall to restart a climb. It is also useful in industrial situations where positioning at a precise point on a structure is required.

It will be appreciated that in some circumstances, for example during maintenance of an artificial climbing surface, it will be beneficial if the winding reel can be operated to act as a lifting device to raise a person engaged in maintenance work. For such circumstances the normal 'fail safe' operation of the winding reel can be overridden, for example by entering a key or a key code to the remote control device, which allows access to an optional lifting mode of the control mechanism which allows winding in under load (tension), by the belay device of the invention. Using a belay device of the invention as a lifting device can also be beneficial in many industrial situations. With an appropriately powered winding reel (with sufficient torque) a belay device of the invention can be used to lift dead weights, such as building materials, whilst another device is used to support a climber who is going to use the materials. Similarly a climber can be directly lifted into position if required by using a device of the invention. For safety reasons, when a climber is being lifted it is preferred that two ropes are used. Preferably where two ropes are employed the winding reel of the belay device is partitioned into two winding sections. Each winding section can then be loaded with a separate rope. By this means both the ropes are operated together by a single belay device. Alternatively two devices of the invention can be used, each with a rope connected to the climber being lifted. Where two devices are used, they can be located at each corner of the face of a building. This has the benefit of allowing a "climber" to be lifted to any position across the height and width of the face of the building by controlling the amount of rope wound in on each of the two spaced apart winding reels.

In use in a commercial climbing facility, the remote control system can also be provided with a timer mechanism, which allows use of the belay device to be purchased on a 'by time' basis.

Although when used for top rope climbing the belay device can be positioned at the top of a climb with the rope hanging down it can more conveniently be placed on the ground. The winding reel is then used for top rope climbing by running the rope up and over a pulley situated at the top of the climb. Positioning the winding reel at the foot of a climb allows easy access for maintenance and also allows the belay device of the invention to be used for lead climbing. In some situations, for example, where the belay device is being used to provide safety to a climber who is working on the outside of a building, the belay device may be mounted so as to be moveable along a track or runway. This arrangement can also be used in a sport climbing facility where the belay device, in use for top rope climbing, can be located on a track that runs along the top edge of a climbing wall. The belay device can then be moved as desired to a chosen climbing route on the wall. Mounting the belay device on a track or runway allows it to be moved easily, on wheels running on rails for example, along a predetermined route, such as along the top edge of a building. This allows access to any part of the face of the building when using the belay device. The movement of the device along the track may be remotely controlled if desired. If it is required that an climber move along a pre-determined course, perhaps with varying height, then the belay device can be programmed to move along the track and wind in or out the rope to conform to the required course. For other, applications, such as tree surgery or steeplejack work a belay device of the invention may be mounted conveniently on a truck or other vehicle for mobility.

When being used for lead climbing the rope is kept taut, only unwinding when the climber climbs and some tension is applied to the rope. If the climber should fall, the control mechanism switches the winding reel to fall or descent mode and then the climber will immediately be suspended by the rope from the highest securing means used and then can be lowered to the ground at a pre-determined (safe) rate in similar fashion to that of the top rope climbing. In lead climbing it is particularly important that the control of the tension in the rope and the winding in and winding out operations of the reel are carefully controlled. Unlike with top rope climbing the control mechanism must allow a climber to pull out some rope from the winding reel, in order to allow a portion of rope to be lifted for attachment to the next anchoring point (such as a temporary or permanent ring bolt or a quick draw) as the climber climbs. This process of "pulling out" a length of rope must be undertaken quickly, at approximately double the speed of the normal operation of the device. However the process of pulling the rope out must not trigger the override switch mechanism, which could cause the rope to be unwound further or stop the winding reel operating. Similarly when the rope has been clipped into the next anchoring point the device must act to wind back in any excess of rope to return to the desired taut rope situation. Testing has shown that the fine control required for optimum safety and operation when lead climbing is achieved with electronic control system described earlier.

The control mechanism may comprise a pivot formed and arranged so that, in use of said belay device, said powered winding reel rests in a first position when said rope is not under tension and moves about said pivot to a second position when said rope is under tension; at least one switch for controlling the powering of said winding reel, said switch being, in use of the belay device, operable when the powered winding reel moves between said first and second positions; and, an override switch mechanism, said override switch mechanism being formed and arranged so that, in use of said belay device, said override switch mechanism is actuated when said rope in under a tension substantially equal to or greater then the weight of a climber attached to said rope, and can allow the winding reel to unwind the rope.

Preferably the pivot rotates the powered winding reel about a horizontal axis. Desirably the pivot is located near but not at the balance point for the reel and its associated motor. The winding reel then rests tilted from the horizontal, usually with one end resting on a base support (or the ground). When tension is applied to the rope the reel tilts from the first to the second position, moving back to the first position, under gravity, when the rope slackens.

It will be appreciated that other embodiments of the control mechanism of the invention can be envisaged. For example where the pivot rotates the reel about a vertical axis when the rope is under tension. In such a case the reel is returned to its first position by the action of a resilient biasing member such as a spring, when the rope is no longer under tension.

The switch or switches for controlling the operation of the reel can be micro-switches located at a point of contact between an end of the reel and a base support or the ground. As the reel tilts the micro-switch operates when under pressure from the reel contacting the ground or support. Alternative switches such as tilt switches can be envisaged for use in the control mechanism.

For top rope climbing the switch operation acts so as to reel in the rope when it is not under tension and the reel is in the first position. When the rope is under tension and the reel moves to the second position the switch or switches operate to stop the reel. For smooth operation, continuous uptake of the rope as the climber climbs and near immediate stopping when the climber pauses, it is desirable that the amount of movement of the reel about the pivot is small. Typically the movement can be as little as 5 mm.

For lead climbing the switch operation controls a different action. The rope unwinds when under light tension, stops when slack or when under a tension substantially equal to or greater than the weight of a climber.

The override switch mechanism is operated when the weight of the climber is on the rope, i.e. where the belay device has been switched to fall or descent mode. In this circumstance lowering of a climber to the ground may then be desired or required. The override switch mechanism inputs to the electronic control and diagnostic system which can allow descent to occur, for example when permitted by a timer mechanism or when commanded by a remote control device carried by the climber, as mentioned previously.

The override switch mechanism may comprise a biasing means which prevents a switch, for example a micro-switch, being operated until the rope is subjected to at least the weight of a climber and the tension displaces the winding reel from its biased position to operate the switch. For example the biasing means may comprise a compression spring or a counterweight.

Alternative mechanisms for the override switch can be envisaged, for example releasing the reel to unwind the rope could be initiated after an electronic load cell or strain gauge measures the load being applied to the winding reel and rope assembly. Where an electric motor is employed to power the winding reel electronic monitoring of the loading on the motor can be used.

Preferably the control mechanism further comprises a remote control device to switch on the winding reel power and to override the normal operation of the control mechanism when required e.g. for maintenance as previously described.

Preferably the control mechanism comprises; a lever, operable in use by said rope, and a biasing means, said lever and said biasing means being formed and arranged so that in use of said belay device said lever is held in a first position by the biasing means when the rope is not under tension and moves to a second position when said rope is under tension; at least one switch for controlling the powering of the winding reel, said switch being operated when the lever moves between said first and second positions; and an override switch mechanism, said override switch mechanism being activated when said rope is under a tension substantially equal to or greater than the weight of a climber attached to said rope and in use of the device, allowing said winding reel to unwind until tension is reduced.

The switch or switches, which are operated when the lever moves, may be, for example, micro switches which operate when contacted by the lever. As an alternative to the use of micro switches a potentiometer may be used. The potentiometer may be mounted on a bearing of the winding drum and reacts to the movement of the lever to provide continuous feedback, as to the position and/or movement of the lever, to the programmable electronic control system. This arrangement, give a reduced number of moving parts together with increased sensitivity to lever arm movement.

The biasing means can be for example a weight or weights, which act to keep the lever in the said first position. Advantageously, the sensitivity of the control mechanism can be adjusted for different situations by varying the number or size of weights installed. It has been found during testing of a belay device of the invention where a lever mechanism is employed that the optimum weight required for different climbing situations can vary significantly (from 1 kg to 9 kg with the equipment used), in particular depending on the friction imposed on a rope as it passes over climbing surfaces and through intermediate anchorage points.

Advantageously, as an alternative to weights, the biasing means may comprise an electrically operated actuator tensioning a biasing member, such as for example a spring, which acts to apply a variable load to the lever. Such a mechanism has the advantage that it can easily be adjusted to apply the optimum load to the lever for a given situation. As a climber prepares to climb a wall or obstacle he can operate a controller, for example by turning a dial, to gradually increase the load imposed on the lever by the actuator and biasing member. When the rope just starts to move upwards, by operation of the winding reel, the load on the lever is set to compensate for the friction applied to the rope. Where an electrical actuator and biasing member are used to provide a variable load (resistance) to the lever, the use of a potentiometer to determine the actions of the lever, as described above is particularly preferred. The electronic control and diagnostic system can be used to control the actuator to deliver a progressive resistance via the biasing member to the lever.

As an alternative to an arrangement where the motor drives the winding reel directly via a gear box, a clutch mechanism can be inserted in the drive chain. For example, the motor may, via a gearbox, constantly drive a shaft to which the winding reel attaches only when a clutch mechanism, for example an electromagnetic clutch, is activated to grip the driven shaft. Such an arrangement can for example use the control mechanism comprising the lever and biasing means as described above to control the operation of the clutch.

Such an arrangement can be used in top rope climbing or lead climbing.

In top rope climbing when the rope is not under tension the clutch is activated by the control mechanism and the winding reel is driven to wind in the rope. When the rope is under tension the clutch disengages from the driven shaft, causing the winding reel to stop.

In lead climbing when the rope is under tension (not sufficient to operate the override switch mechanism) the clutch engages the driven shaft to pay out rope. When the rope is not under tension the clutch disengages from the driven shaft and winding stops.

Since the winding reel is in this case not directly attached to a gearbox and motor it is not constrained from turning and rapidly paying out rope when the weight of a climber tensions the rope. Therefore to prevent uncontrolled descent, when the override switch of the control mechanism operates, as a consequence of the weight of a climber on the rope, the clutch is commanded to rapidly engage and disengage repeatedly with the driven shaft. This has the effect of gradually lowering the climber to the ground as the winding reel is both turned by the weight of the climber and braked by the intermittent engagement with the driven shaft, via the clutch.

This arrangement has a particular benefit. It allows operation of more than one winding reel from a single motor. The motor constantly drives a shaft to which several winding reels can be attached at intervals, for example spaced along the top of an indoor climbing wall for top rope climbing. Each winding reel engages as required with the driven shaft via a clutch controlled by control mechanisms such as described before. This allows several climbers to climb without the need to provide a separate motor for each. Additionally, descent is automatic when the weight of a climber tensions the rope, no command from a remote control device is required.

Further preferred features and advantages of the present invention will appear from the following detailed description of some embodiments illustrated with reference to the accompanying drawings in which:

FIG. 1 shows an embodiment of a belay device of the invention arranged for top rope climbing;

FIGS. 2*a-c* illustrate schematically the use of a belay device of the invention in top rope and lead climbing;

Figure 1:
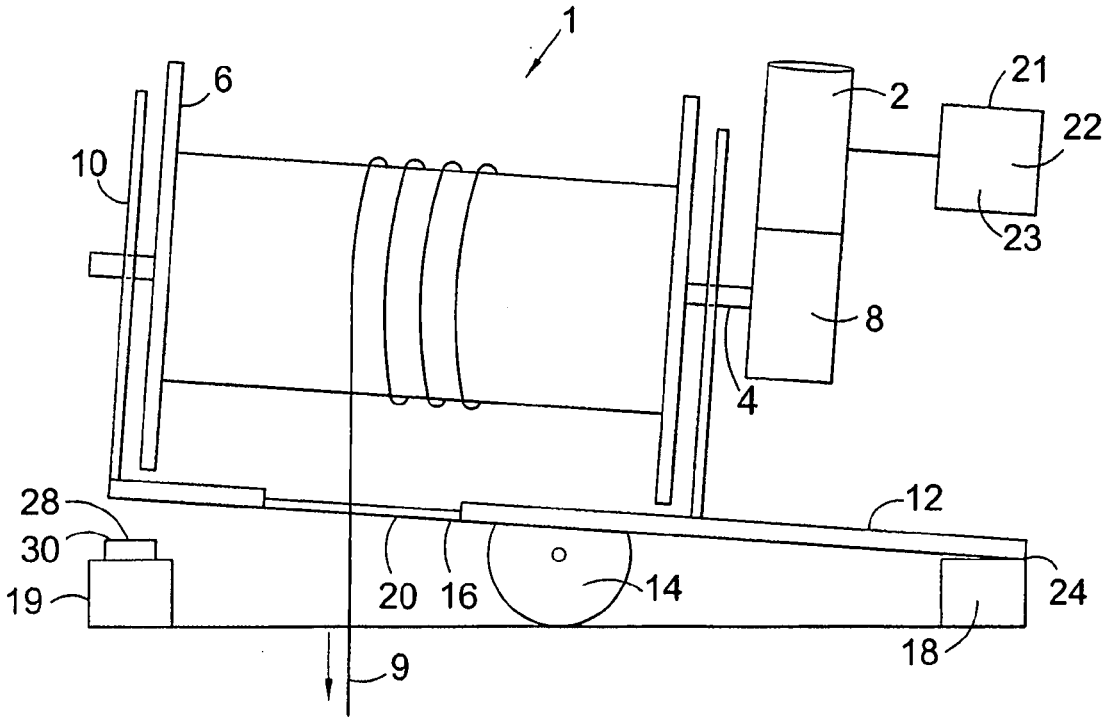

In the drawings, similar features are denoted by the same reference signs throughout.

FIG. 1 shows an embodiment of the belay device of the invention. The belay device 1 comprises an electric motor 2, which drives a centre shaft 4 of a winding reel 6 via a gearbox 8. The winding reel 6 has a climbing rope 9 attached (only a few turns of rope 9 are shown for clarity in FIG. 1).

The winding reel, electric motor and gearbox are mounted on a cradle 10, which has a base plate 12. The base plate 12 is mounted on a horizontal pivot 14. The pivot 14 is positioned near, but not at, the balance point 16 of the device so that, in the absence of a load applied via the climbing rope 9, the cradle 10 tilts under gravity to rest on a support 18. When the rope 9 is under tension the cradle 10 tilts to rest on a second support 19.

In the example shown the belay device 1 is to be sited at the top of a climb and used for top rope climbing, with the climbing rope 9 feeding downwards through a slot 20 in the base plate 12.

A control box 21 contains the electronic control and diagnostic system 22 and an inverter 23, which controls the operation of the electric motor 2. In use of the belay 1, when the rope 9 is not under tension (i.e. is slack) the cradle rests on the support 18 and a micro-switch 24 located on the base plate 12, between the base plate 12 and the support 18 is operated by their contact. The micro-switch 24 signals the electronic control and diagnostic system 22, which causes the inverter 23 to power the motor 2 to operate so that the winding reel 6 winds in the rope 9. When the rope 9 comes under tension, i.e. the slack has all been taken up; the belay device 1 tilts about the pivot 14 until it rests on a second support 19. A second micro-switch 28 is operated by the contact of the base plate 12 to the second support 19, signalling the electronic control and diagnostic system 22 to stop the motor 2.

Also located on the second support 19 is an override switch mechanism 30 comprising a compression spring and a third micro-switch.

When the tension in the rope 9 is released (as a climber climbs higher) the belay device then pivots under the influence of gravity to rest once more on the first support 18 where the operation of the first micro-switch 24 initiates the winding in action again.

Thus the tilting of the device about the pivot 14 as the rope 9 is tensioned and released by the actions of a climber is used to control the operation of the winding reel 6 to keep the rope 9 properly taut during climbing.

In the event of a fall the rope 9 is tensioned by the weight of the climber and so the belay 1 tilts about the pivot 14 to rest on the second support 19 operating the second micro-switch 28 and so the motor 2 is stopped (not powered) The ratios of the gears in the gearbox 8 are chosen so as to hold the climber in position whilst suspended by the rope. The tension is the rope 9 caused by the weight of the climber compresses the spring to allow operation the third micro-switch of the override switch mechanism 30. The operation of the override switch mechanism allows descent to be permitted. If a fallen climber wishes to descend they can then use their a wireless remote control device (not shown) to signal to the electronic control and diagnostic system 22 to initiate the un-winding of the rope 9 by the winding reel 6.

Similarly, when a climber who has completed a climb wishes to descend, they simply let go of the climbing surface to allow their weight to tension the rope 9 causing the override switch mechanism 30 to operate and then use their remote control device to initiate the un-winding of the rope.

Figure 2A:
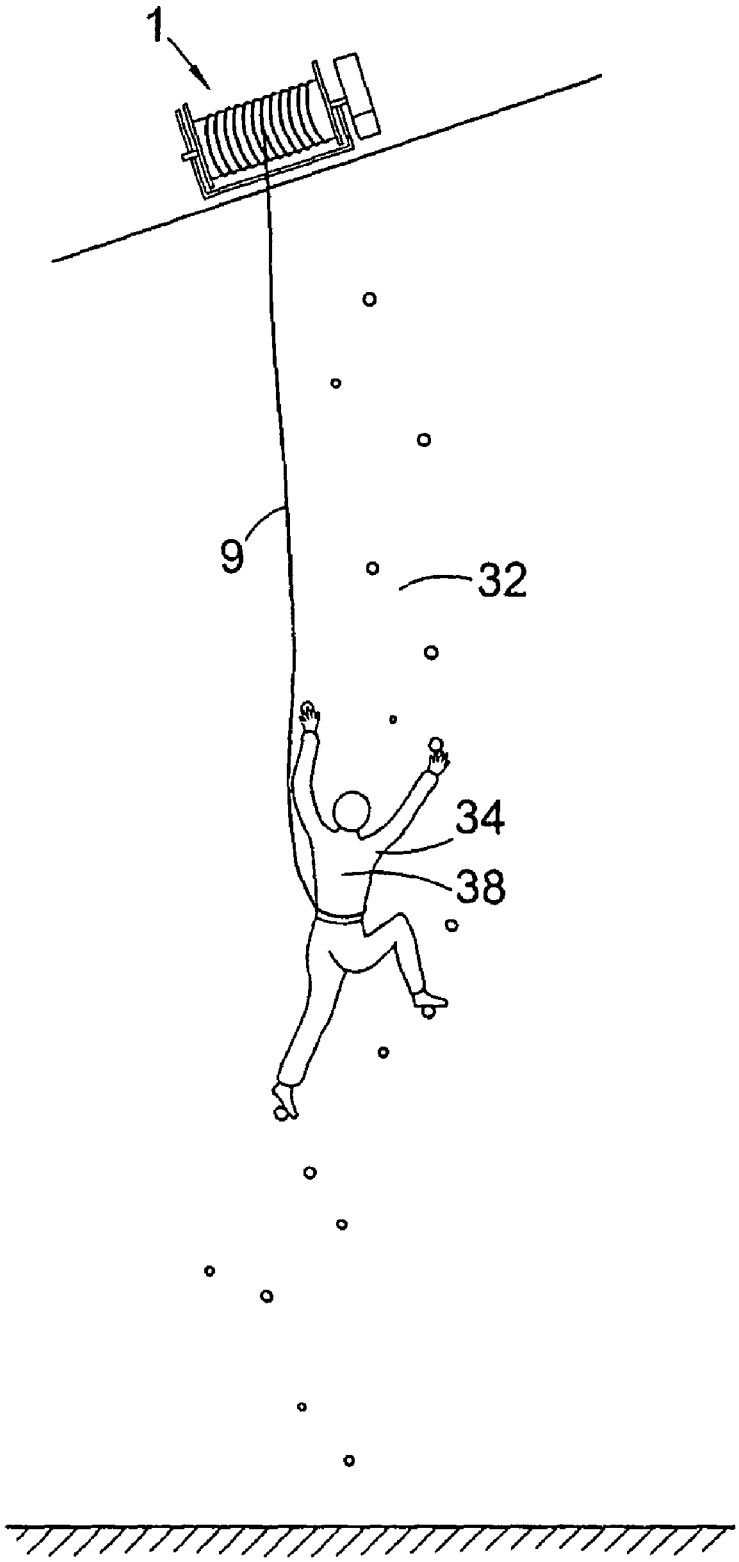

FIG. 2*a* shows a general view of the use of the belay device 1 of FIG. 1 in top rope climbing. The belay device 1 is situated at the top of a climbing surface 32. A climber 34 ascends the climbing surface whilst attached to the rope 9, connected to the belay device 1. The rope 9 is kept taut by the controlled winding in by the belay device as described previously for FIG. 1. The climber 34 carries a wireless remote control device 38 which is used to initiate the operation of the belay device 1 at the start of climbing and to initiate descent (un-winding of the rope) when the weight of the climber tensions the rope and operates the override switch mechanism.

Figure 2B:
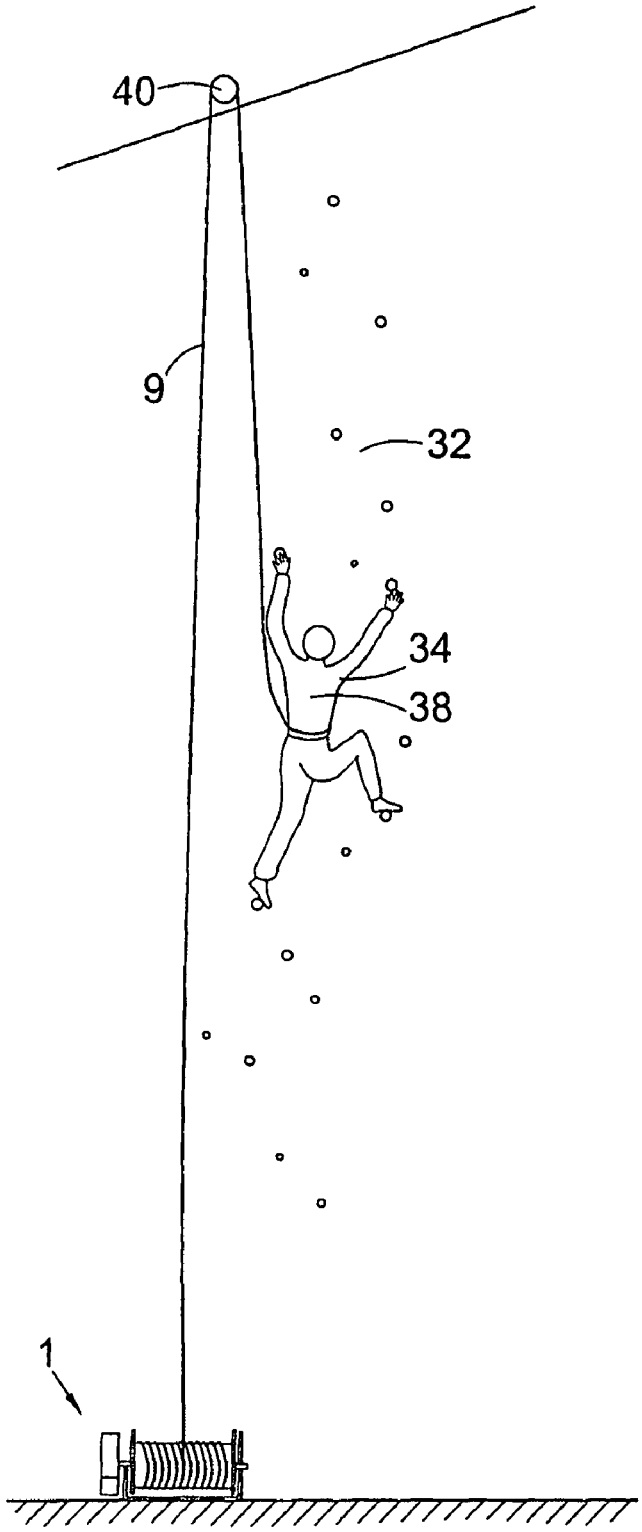

FIG. 2*b* shows an alternative arrangement for top rope climbing where the belay device 1 is situated at the bottom of a climbing surface 32. The rope 9 passes up and round a pulley 40 situated at the top of the climbing surface and then down to a climber 34.

Figure 2C:
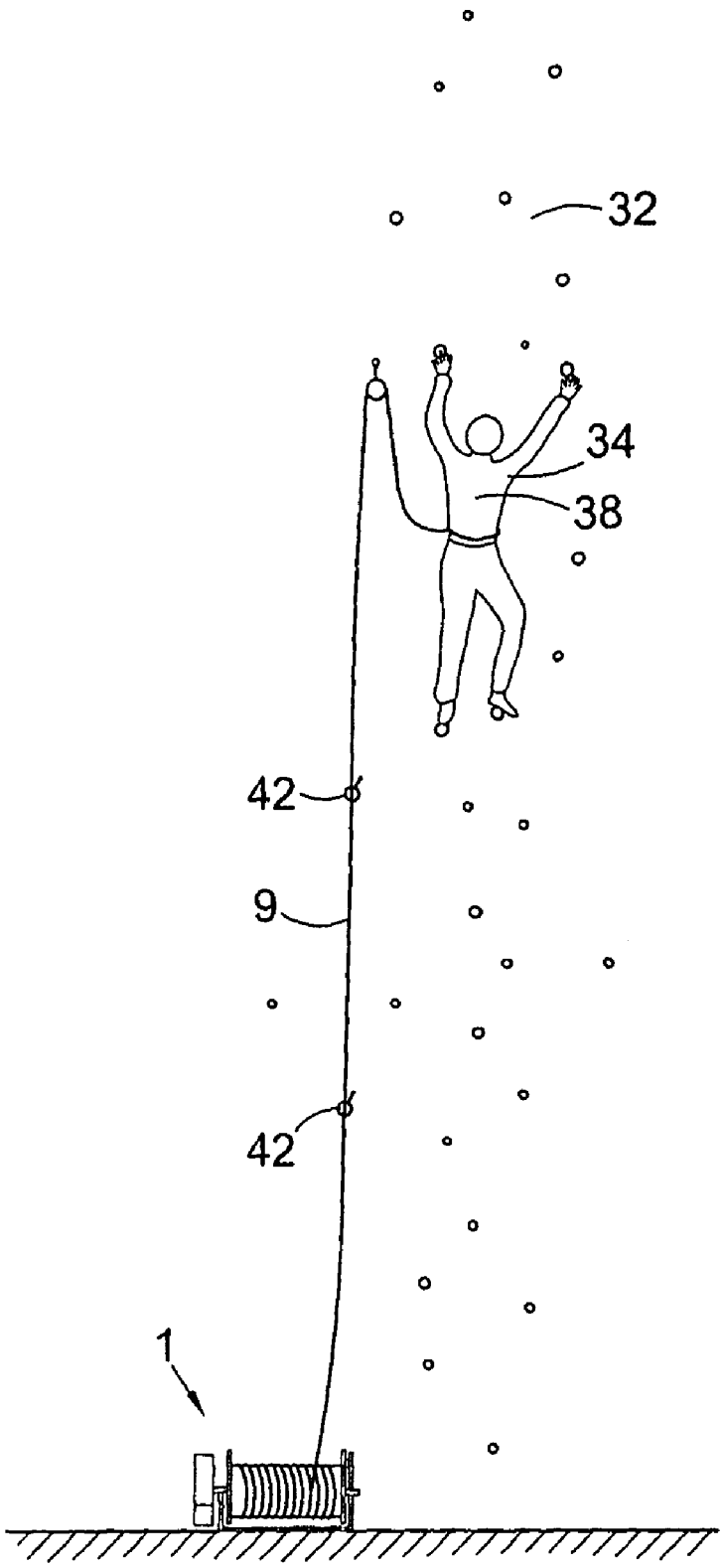

In FIG. 2*c* lead climbing is shown. A climber 34 makes his/her way up the climbing surface 32, periodically fixing the rope 9 into carabiners 42 securely fixed to the climbing surface. In this case the control mechanism of belay device 1 pays out rope 9 when it is under tension i.e. pulled up by the climber, except when the tension is substantially equal to a greater than the weight of a climber. In which case the fall or descent mode is engaged by the operation of the override switch and the winding reel, on the belay device 1 stops. The climber can then initiate descent, if desired, by using a remote control 38 to cause the unwinding of the rope 9 lowering the climber safely to the ground.

Figure 3A:
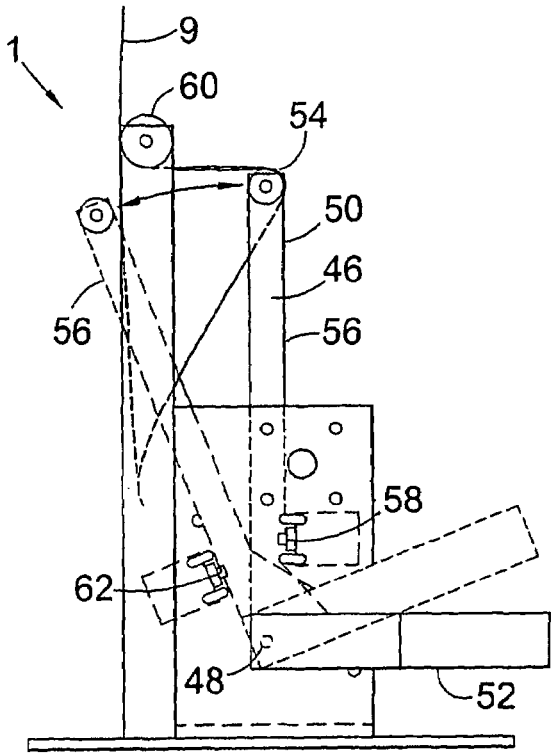
FIG. 3 shows another embodiment of a belay device according to the invention with an alternative control mechanism.

FIG. 3 shows a further embodiment of the belay device according to the invention, which uses the movement of a lever, rather than the pivoting of a winding reel, gearbox and motor assembly as a whole, for control of the winding reel operation. The winding reel 6 is mounted in a support cradle 10 by bearings 44 at either end of its drive shaft 4. In the interests of clarity the motor and gearbox, which drive the winding reel shaft 4 are not shown in the illustration, the rope is only shown on the end view (FIG. 3*a*), and the end view does not show the winding reel. Two 'L' shaped arms 46 are mounted by pivots 48 to the support cradle 10 at either end of the winding reel so they both rotate about the same axis parallel to the winding reel shaft 4 from a first position (shown in solid line in the end view FIG. 3*a*) to a second position (shown in dashed line in end view FIG. 3*a*).

The arms 46 each have a generally vertical portion 50 and a generally horizontal portion 52 making up the 'L' shape. The arms 46 are connected to each other by a horizontally disposed roller 54 attached at each end to the top ends of the generally vertical portion 50 of the L shaped arms 46 to form a control lever 56. The vertical portions are of sufficient length so that the roller 54 is held clear above the winding reel and a climbing rope 9 wound round it, even when the rope 9 is fully wound in.

The generally horizontal portions 52 of the 'L' shaped arms 46 are weights which act to bias the control lever assembly 56 about the pivots 48 to the first position, where one of the vertical portions 50 contacts and operates a first micro-switch 58.

The climbing rope 9 winds round the winding reel 6 and is lead up and round the roller 54 of the control lever assembly and then round a fixed roller 60 up to a climber (who is not shown in this figure). The fixed roller 60 is mounted on the support cradle 10 and turns on a horizontal axis that is parallel to, but displaced horizontally from, the roller 54 of the control lever 56 when it is in the first position. The horizontal displacement of the fixed roller 60 is in the direction opposite to the direction of bias to the control lever 56 caused by the horizontal portions (weights) of the L shaped arms.

In use for top rope climbing, when the rope 9 is not under tension the control lever assembly remains biased to the first position and the micro-switch 58 is operated signalling electronic control and diagnostic system 22 to operate the motor and gear box to cause the winding reel 6 to wind in the rope 9 (take up slack). When the rope 9 comes under tension the portion of the rope 9 between the fixed roller 60 and the winding reel acts to pull the control lever assembly to the second position where a second micro-switch 62 is operated by the contact of the vertical portion 50 of one of the 'L' shaped arms 46 and causes the electronic control and diagnostic system 22 to stop the motor and winding reel 6.

When the tension in the rope 9 is released (as the a climber climbs higher) the control lever 56 moves back to the first position again under the biasing influence of the horizontal portions (weights) 52 of the L shaped arms 46 and the movement of the control lever 56 between the first and second positions as the rope 9 is tensioned and released by the actions of a climber is used to control the operation of the winding reel 6 to keep the rope 9 properly taut during top rope climbing.

An override switch mechanism 64 is provided, operating when the line is under a tension equal to or greater than the weight of a climber, in this example it is a sensor measuring the load on the winding reel which signals the control box 22 to engage descent mode. When in descent mode a climber is held in position (the winding reel is stopped) and can, if he wishes to descend, use a wireless remote control to signal the control box to operate the motor to cause the rope to unwind, lowering the climber to the ground.

For lead climbing the operation of the winding reel 6 in response to the position of the control lever 56 is reversed i.e. electronic control and diagnostic system 22 is programmed to respond differently to the signals of the micro-switches. The winding reel 6 pays out line when under tension (when the lever is in the second position) i.e. as the climber climbs and the rope is pulled up. The winding reel stops when the rope 9 is not under tension (the lever is in the first position).

For lead climbing with this embodiment, the override switch 64 stops the winding reel 6 when under tension equal to or greater than the weight of the climber. This allows the climber to continue climbing after a fall without losing height caused by winding out of the rope immediately after a fall.

Figure 3B:
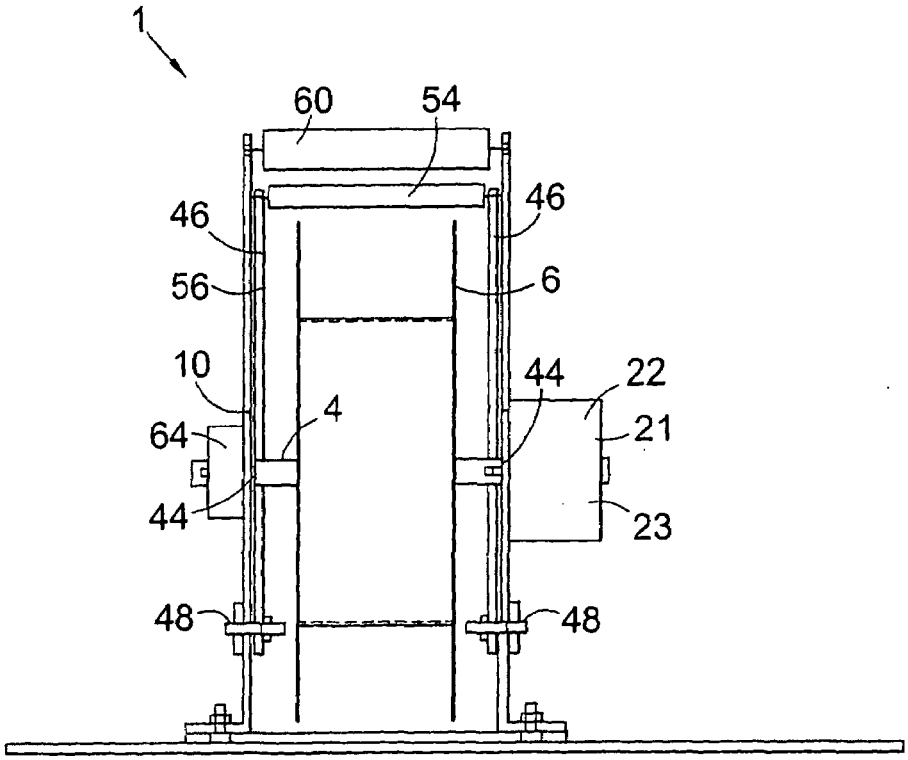
Figure 4:
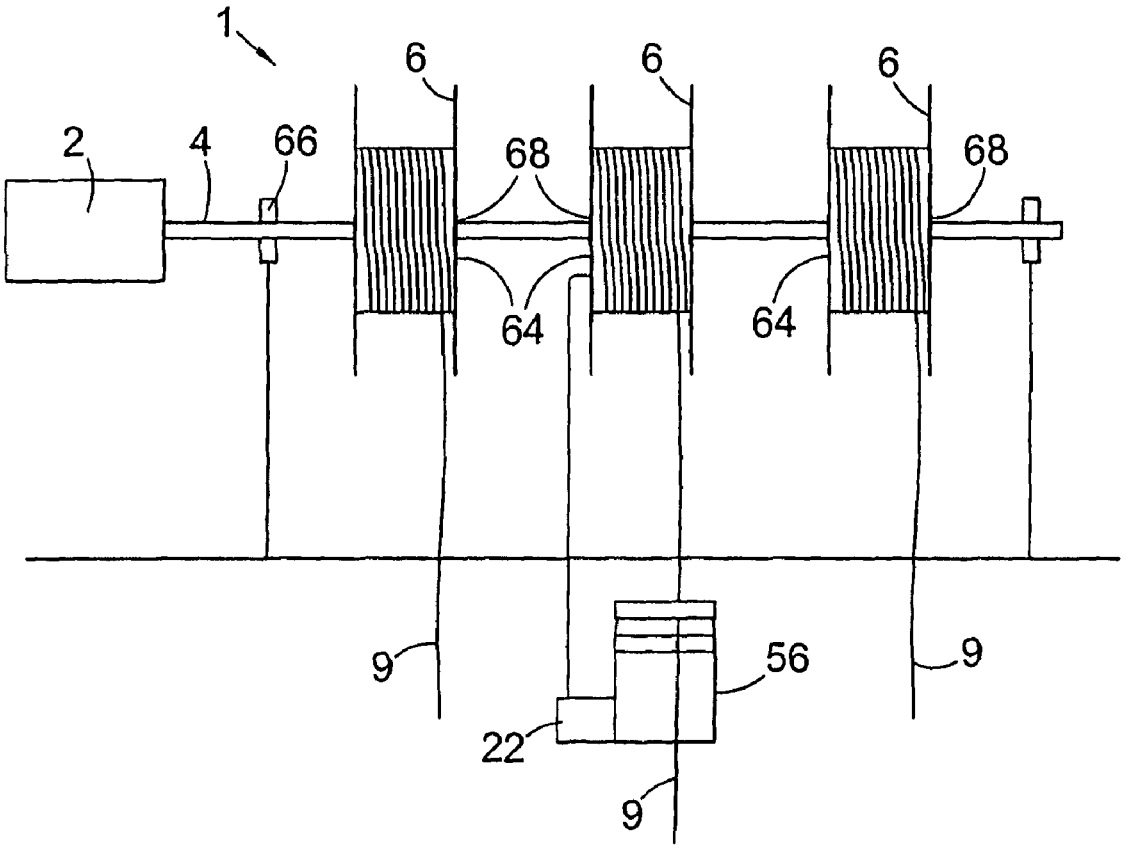
FIG. 4 shows an embodiment of the belay device of the invention where three winding reels are driven from a single motor to which they engage by clutch mechanisms.

FIG. 4 shows an embodiment of the belay device 1 of the invention for mounting at the top of a climbing surface for use in top rope climbing. In normal use a motor 2 constantly drives a shaft 4 mounted in suitable bearings 66. Three winding reels 6 with associated climbing ropes 9 are mounted on the shaft 4 and each can engage separately with it by the operation of electromagnetic clutches 68. The electromagnetic clutches 68 are each separately controlled by lever control mechanisms 56 (only one shown for clarity), of the same general form as that of the embodiment of FIG. 3. The lever control mechanisms 56 respond to tension in their respective ropes 9 by signalling the electronic control and diagnostic system 22, which operates the electromagnetic clutch 68 to engage or disengage the winding reel 6 with the driven shaft.

In use each winding reel 6 attaches via its clutch 68 to the shaft 4 when the respective rope 9 is not under tension so that the rope is wound in on the winding reel 6. When the rope is under tension the control lever 56 moves and signals to the electronic control and diagnostic system 22, which releases the clutch 68, stopping winding in. If the tension is equal to or greater than the weight of a climber a sensor detecting the load on the winding reel (override switch mechanism 64) signals the electronic control and diagnostic system 22 to engage a descent mode where the electromagnetic clutch 68 rapidly engages and disengages the winding reel 6 with the driven shaft 4. The weight of the climber on the rope causes the winding reel 6 to unwind the rope 9 but the speed of descent is moderated to a safe rate by the braking action when the clutch 68 intermittently engages the winding reel 6 to the shaft 4.

Figure 5:
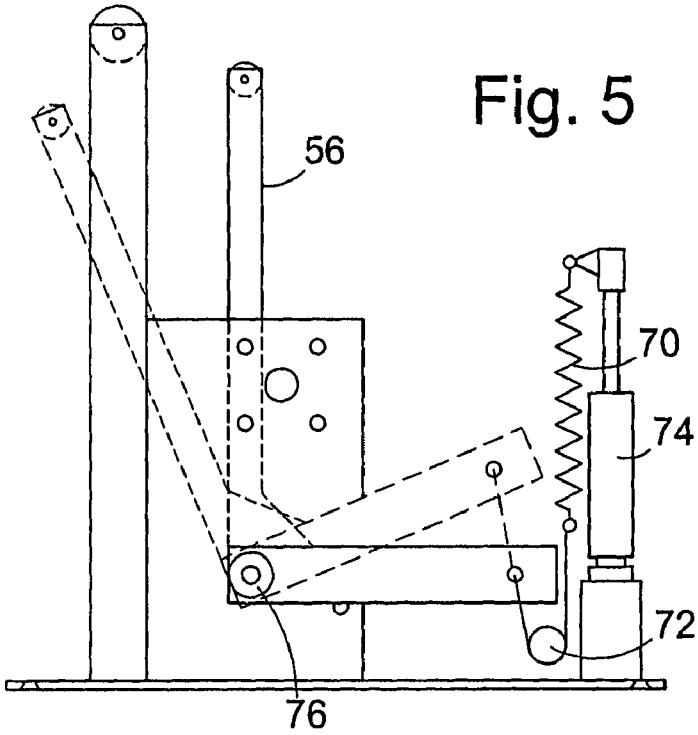
FIG. 5 shows a further alternative embodiment of the belay device.

FIG. 5 shows another embodiment of a belay device of the invention, generally similar to that of FIG. 3 except that the control lever 56 is not weighted as a means to bias it to its first position and alternative means are used to detect the movement of the lever 56. In this example the lever 56 is biased to the first position by a spring 70, as biasing member, operating about a pulley 72. The tension applied by the spring 70 is adjustable by means of an electrically operated actuator 74, which is controlled by the electronic control and diagnostic system 22 (not shown, see FIG. 3*b*). In this case, as an alternative to micro switches the position and movement of the lever 56 is detected by a potentiometer 76, mounted on a bearing of the winding reel 6, which transmits signals to the electronic control and diagnostic system 22 (see FIG. 3*b*) to control the winding reel operation and the operation of the actuator 74. In use the potentiometer 76 can be more sensitive than an arrangement that employs micro-switches leading to more sensitive monitoring of the lever arm.

Figure 6:
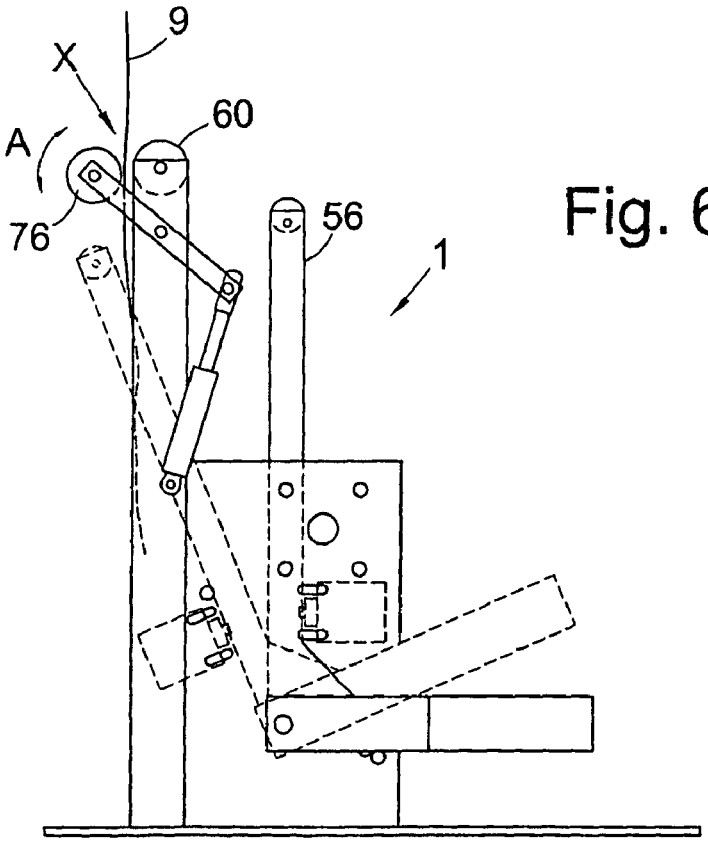
FIG. 6 shows a yet further embodiment of the belay device with a nip roller mechanism fitted.

FIG. 6 shows an embodiment similar to that of FIG. 3, which shows a nip roller 76 mounted on a pivot 78 and moveable by means of an electrically operated actuator 80. The nip roller 76, can be moved by the actuator 80 about an arc indicated by the curved arrow A. When the belay device 1 is in normal use during climbing the nip roller 76 is spaced apart from the fixed roller 60 so as not to interfere with the safe operation of the control lever 56. When a length of rope 9, not under tension from being attached to a climber, has to be wound back onto the winding reel (not shown in this view, see FIG. 3*b*) the belay device 1 is put into a rewind mode where the actuator 80 moves the nip roller 76 close to the fixed roller 60 to grip the rope at the point X. This has the effect of applying tension to the rope as it is wound onto the winding reel ensuring that no loose loops of rope form on the winding reel.

Figure 7A:
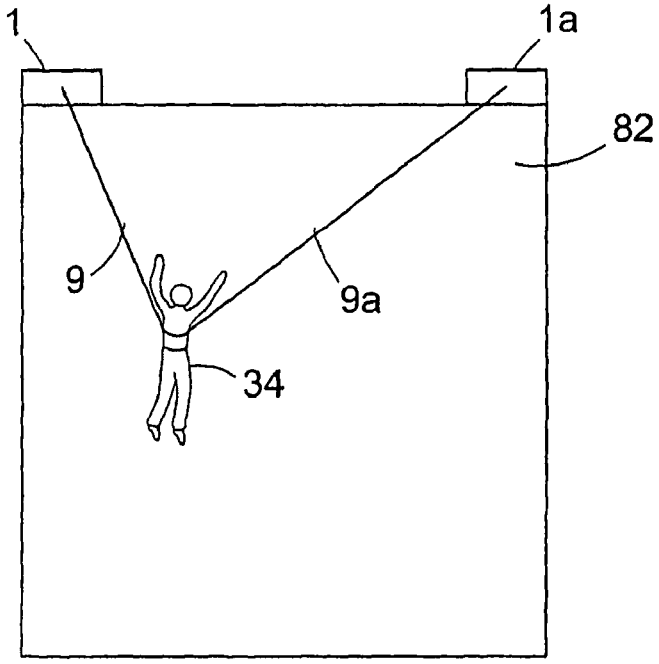
FIG. 7 (*a,b*) illustrates schematically the use of belay devices of the invention to provide access to the face of a building.

FIG. 7*a* shows two belay devices 1,1*a* of the invention located at either end of the top edge of a wall 82 of a building. A climber 34 is attached by ropes 9,9*a*, to each of the belay devices 1,1*a*. By using a wireless remote control (not shown) the climber 34 can be lifted by the operation of the belay devices 1,1*a*. By commanding different amounts of each rope 9,9*a* to be wound in by the belay devices 1,1*a* the climber traverse across the surface of the wall 82 as well as be lifted up or down.

Figure 7B:
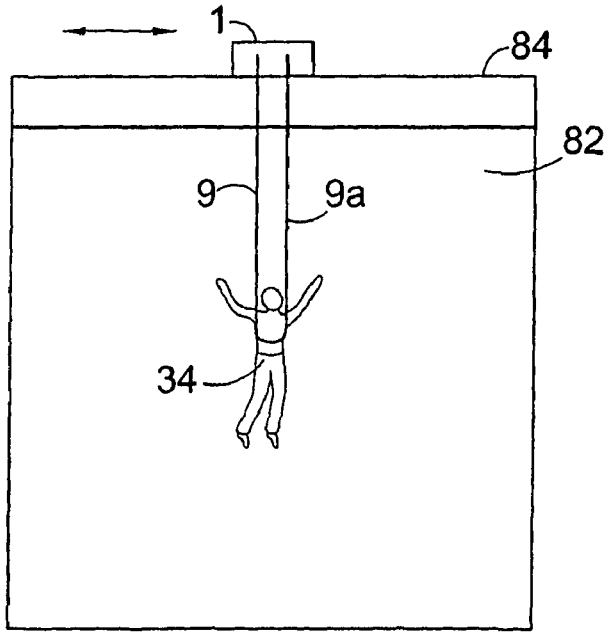

FIG. 7*b* shows a belay device 1 mounted on a rail 84 along the top edge of a building wall 82. A climber 34 is attached to the belay device 1, which has a partitioned winding reel, by two ropes 9,9*a*. The second rope provides additional safety. In use the climber can operate the winding reel of the belay device 1 to raise or lower himself and also cause the belay device 1 to move along the rail 84 by means of an electric motor. Thus the climber 34 can reach any part of the wall 82 to carry out maintenance work.

Various modifications may be made to the embodiments described above without departing from the scope of the present invention.

The invention claimed is:

1. A belay device comprising:

a powered winding reel;

a climbing rope attached at one end to the winding reel and, in use of the device, to a climber a distal portion along said rope; and a control mechanism comprising load sensing means and an electronic control and diagnostic system, said control mechanism being formed and arranged so as to control the powered winding reel in a first, climbing, mode wherein the winding reel operates to prevent slack in the rope between a said climber in use of the device and said winding reel, the load sensing means is formed and arranged to detect the weight of a said climber on the rope, and to switch the operation of the winding reel to a second, fall or descent mode, wherein the winding reel is stopped and a said climber is suspended by the rope, and the electronic control and diagnostic system is formed and arranged to monitor the operation of the powered winding reel and the control mechanism, and to switch the operation of the winding reel to a third, fault mode, wherein the winding reel is stopped, when a discrepancy in the operation of the powered winding reel and/or the control mechanism is detected.

2. A belay device according to claim 1 wherein the winding reel is powered by an electric motor.

3. A belay device according to claim 2 wherein the winding reel is powered by a three phase electric motor and the electronic control and diagnostic system controls an inverter, which controls the speed and direction of the said motor.

4. A belay device according to claim 1 wherein the electronic control and diagnostic system monitors any one of: outputs from the control system, outputs from sensors, and inputs and outputs from an inverter.

5. A belay device according to claim 1 wherein the electronic control and diagnostic system is programmable.

6. A belay device according to claim 1 wherein, in climbing mode, the winding reel winds the rope in whenever there is slack in the rope and unwinds to pay out rope when under a tension less than the weight of a climber.

7. A belay device according to claim 1 wherein, in climbing mode, the winding reel winds the rope in whenever there is slack in the rope and does not unwind rope when under a tension less than the weight of a climber.

8. A belay device according to claim 1 wherein the control mechanism further comprises security means to prevent operation in a manner inappropriate to the climbing method being attempted.

9. A belay device according to claim 1, further comprising a nip roller mechanism, formed and arranged to apply tension between a rope being wound onto the winding reel and the winding reel.

10. A belay device according to claim 1, further comprising a self-tailing mechanism, to control the layering of the rope onto the winding reel.

11. A belay device according to claim 1, further comprising a drive train, formed and arranged to hold a fallen climber in position, close to the point where they fell, in use of the device.

12. A belay device according to claim 1, comprising a timer mechanism that, when an adjustable period of time has elapsed, automatically activates a lowering sequence to lower a climber safely to the ground when the weight of a climber tensions the rope.

13. A belay device according to claim 1, comprising a remote control device formed and arranged to initiate the operation of the belay device in its first mode and for signalling the control mechanism to unwind the rope for descent when in its second mode.

14. A belay device according to claim 13 wherein the remote control device is wireless.

15. A belay device according to claim 12 wherein the remote control allows the use of the belay device to be purchased on a by time basis.

16. A belay device according to claim 1, comprising a pulley, for locating at the top of a climb, and around which, in use, a rope runs for top rope climbing.

17. A belay device according to claim 1, which is formed and arranged to operate as a lifting device.

18. A belay device according to claim 17 wherein two ropes are provided, to support a climber, in use of the device.

19. A belay device according to claim 18 wherein the winding reel is partitioned into two winding sections, each loaded with one of the ropes.

20. A belay device according to claim 1, which is formed and arranged to be mountable, in use, on a track or runway, along which it may be moved.

21. A belay device according to claim 20, which can be moved along the track or runway by remote control.

22. A belay, device according to claim 20 wherein the belay device is programmed to move along the track or runway and to wind in or out the rope so that a climber follows a predetermined course.

23. A belay device according to claim 1, wherein the control mechanism comprises a pivot formed and arranged so that, in use of said belay device, said powered winding reel rests in a first position when said rope is not under tension and moves about said pivot to a second position when said rope is under tension; at least one switch for controlling the powering of said winding reel, said switch being, in use of the belay device, operable when the powered winding reel moves between said first and second positions; and, an override switch mechanism, said override switch mechanism being formed and arranged so that, in use of said belay device, said override switch mechanism is actuated when said rope in under a tension substantially equal to or greater then the weight of a climber attached to said rope, and can allow the winding reel to unwind the rope.

24. A belay device according to claim 23 wherein the pivot rotates the powered winding reel about a horizontal axis.

25. A belay device according to claim 24 wherein the pivot is located near but not at the balance point for the winding reel.

26. A belay device according to claim 23 wherein the pivot rotates the reel about a vertical axis when the rope is under tension and the winding reel is returned to its first position by the action of a resilient biasing, member when the rope is no longer under tension.

27. A belay device according to claim 23 wherein said at least one switch for controlling the operation of the winding reel is a micro-switch located at a point of contact between an end of the reel and a base support or the ground.

28. A belay device according to claim 23 wherein said at least one switch is a tilt switch.

29. A belay device according to claim 1 wherein the control mechanism comprises; a lever, operable in use by said rope, and a biasing means, said lever and said biasing means being formed and arranged so that in use of said belay device said lever is held in a first position by the biasing means when the rope is not under tension and moves to a second position when said rope is under tension; at least one switch for controlling the powering of the winding reel, said switch being operated when the lever moves between said first and second positions; and an override switch mechanism, said override switch mechanism being activated when said rope is under a tension substantially equal to or greater than the weight of a climber attached to said rope and in use of the device, allowing said winding reel to unwind until tension is reduced.

30. A belay, device according to claim 29 wherein said at least one switch is a micro switch which operates when contacted by the lever.

31. A belay device according to claim 29 wherein said at least one switch is a potentiometer reacting to the movement of the lever to give continuous feedback.

32. A belay device according to claim 29 wherein the biasing means is a weight or weights, which act to keep the lever in the said first position.

33. A belay device according to claim 32 wherein the sensitivity of the control mechanism is adjusted by varying the number or size of weights installed.

34. A belay device according to claim 29 wherein the biasing means comprises an electrically operated actuator tensioning a biasing member, which acts to apply a variable load to the lever.

35. A belay device according to claim 34 wherein the biasing member is selected from the group including a spring; a hydraulic tensioning device;

a mechanical tensioning device; and a pneumatic tensioning device.

36. A belay device according to claim 34 wherein the actuator is controlled by the electronic control and diagnostic system.

37. A belay device according to claim 23 wherein the override switch mechanism comprises a biasing means which prevents a switch being operated until the rope is subjected to at least the weight of a climber.

38. A belay device according to claim 23 wherein the override switch mechanism comprises a load cell or a strain gauge, which measures the load applied to the winding reel and rope assembly.

39. A belay device according to claim 23 wherein the override switch mechanism comprises an electronic monitor of the loading on the motor.

40. A belay device according to claim 1 wherein the winding reel is powered by a motor via a gearbox which, in use, constantly drives a shaft to which the winding reel attaches only when a clutch mechanism is activated to grip the said driven shaft.

41. A plurality of belay devices according to claim 1 wherein the winding reels are powered by a motor via a gearbox which, in use, constantly drives a shaft to which each winding reel attaches only when a clutch mechanism is activated to grip the said driven shaft.

42. A belay device comprising:

a powered winding reel;

a climbing rope attached at one end to the winding reel and, in use of the device, to a climber a distal portion along said rope; and a control mechanism comprising a load sensor and an electronic control and diagnostic system, said control mechanism being formed and arranged to operate the powered winding reel in a first, climbing mode to prevent slack in the rope between said climber in use of the device and said winding reel;

said load sensor being responsive to the weight of said climber on the rope and providing a signal to said control mechanism when the load sensor detects the weight of said climber on the rope, the control mechanism being responsive to said signal to switch operation of the winding reel to a second, fall or descent mode in which the winding reel is stopped and said climber is suspended by the rope;

wherein the electronic control and diagnostic system is formed and arranged to monitor the operation of the powered winding reel and the control mechanism such that when a discrepancy in the operation of the powered winding reel and/or the control mechanism is detected, the control mechanism switches operation of the winding reel to a third, fault mode in which the winding reel is stopped.

43. A method of securing a climber, comprising:

attaching one end of a climbing rope to a power-driven winding reel and the other end of said rope to a climber;

driving the powered winding reel in a first, climbing mode to prevent slack in the rope between said climber in use of the device and said winding reel;

sensing the weight of said climber on the rope and generating a control signal;

using said control signal to switch operation of the winding reel to a second, fall or descent mode by stopping the winding reel and suspending said climber by the rope; and monitoring the operation of the power-driven winding reel and switching operation of the winding reel to a third, fault mode in which the winding reel is stopped when a discrepancy in the operation of the powered winding reel is detected.

* * * * *